US007318509B2

(12) United States Patent
Barlage

(10) Patent No.: US 7,318,509 B2
(45) Date of Patent: Jan. 15, 2008

(54) TEMPERATURE COMPENSATING HYDRAULIC SHEAR PUMP

(75) Inventor: John A. Barlage, Rochester Hills, MI (US)

(73) Assignee: GKN Driveline North America, Inc., Auburn Hills, MI (US)

( * ) Notice: Subject to any disclaimer, the term of this patent is extended or adjusted under 35 U.S.C. 154(b) by 702 days.

(21) Appl. No.: 10/839,460

(22) Filed: May 5, 2004

(65) Prior Publication Data

US 2005/0249611 A1 Nov. 10, 2005

(51) Int. Cl.

| | |
|---|---|
| ***F16D 43/25*** | (2006.01) |
| ***F16D 31/06*** | (2006.01) |
| ***F16D 43/284*** | (2006.01) |
| ***F04B 17/06*** | (2006.01) |

(52) U.S. Cl. ..... 192/54.3; 192/82 T; 192/103 F; 417/279; 475/88

(58) Field of Classification Search ..... 192/54.3, 192/58.4, 58.42; 475/87, 88
See application file for complete search history.

(56) References Cited

U.S. PATENT DOCUMENTS 5,127,503 A * 7/1992 Gratzer ..... 192/58.42
5,562,191 A * 10/1996 Gassmann ..... 192/58.42
5,935,036 A * 8/1999 Gassmann et al. ..... 475/87
6,299,538 B1 * 10/2001 Gassmann ..... 192/103 F

* cited by examiner

*Primary Examiner*—Rodney H. Bonck

(57) ABSTRACT

Pump pressure output can be controlled as temperature changes by a temperature compensation element. The present invention provides a shear channel constructed out of two or more materials enabling a pump to have a pressure profile as a function of temperature for a viscous fluid. The channel height varies as a function of temperature when the channel walls and temperature compensation element are constructed from materials having different coefficients of thermal expansion. By selecting a combination of materials, the channel height can increase, decrease, or remain constant as the temperature is changed. Ignoring the effects of viscosity, channel length, and relative speed the effect of channel height on pump output pressure is assessed: by increasing channel height as temperature increases, the pressure will decrease; by keeping the channel height constant as temperature increases, the pressure will remain constant; and by decreasing channel height as temperature increases, the pressure will increase.

20 Claims, 3 Drawing Sheets

TEMPERATURE COMPENSATING HYDRAULIC SHEAR PUMP

TECHNICAL FIELD

The invention relates to a hydraulic shear pump and more particularly to a temperature compensating hydraulic shear pump.

BACKGROUND OF THE INVENTION

There is an increasing demand for simple, self-controlling, speed-sensing limited-slip devices having locking characteristics and high torque capacity over a given set of conditions, in particular in Sport Utility Vehicle and light truck axle and transfer case applications. Existing speed-sensing systems have a degressive locking characteristic; some designs are too complex for high volume production. More recent designs of speed sensing limited-slip devices have high-torque progressive engagement and are tuned to minimize driveline windup. One type of a limited-slip device is a limited-slip differential. Progressive types of limited-slip differentials allow for a wide range of calibration in specifying the level of torque transfer at any particular speed difference. This self-controlling stand-alone limited-slip differential type system consists of a shear pump design creating a pressure proportional to a speed difference, which engages a friction clutch to transmit the torque through the drive system. A feature of the shear pump is that it is self-contained and independent, requiring no external source of hydraulic fluid. The viscous shear pump, which is filled, typically, with silicone fluid, provides significant benefits in packaging, temperature stability, durability, and weight. However, the hydraulic fluid undergoes a decrease in viscosity over the operating temperature. When silicone is used as the operating hydraulic fluid, its viscosity decreases linearly as the temperature increases causing a reduction in pump pressure output; decreasing the torque transferring capabilities of the speed sensing limited-slip differential. Also, the torque transfer efficiency, as a function of slip speed, is reduced over the operating temperature by the decrease in viscosity of the hydraulic fluid.

The speed sensing limited-slip differential is comprised of two distinct functional parts: the shear pump and the controlled multi-plate wet clutch. The ability to separate the controlling function from the locking function provides significant flexibility in specifying the torque characteristic at any particular speed difference. The wet clutch provides high power density and reliability for torque transfer. The design of the self-contained viscous shear pump generates a pressure proportional to a speed difference, which engages the friction clutch via a pressure piston to transmit the torque.

The pressure generation in the shear pump is based on shearing a high viscosity silicone fluid in a laterally sealed shear channel. The shear channel consists of a pumping groove located in a plate and a flat surface of a second plate with relative movement to one another. This pump channel is filled with a hydraulic fluid having high viscosity properties, such as silicone fluid. One surface pulls the viscous fluid through the shear channel by the relative speed direction from the beginning of the sealed channel (suction side) to the end (pressure side). With the suction side connected to a reservoir and the pressure side to a pressure chamber that exerts force upon a piston, the shear pump generates a fluid flow from the reservoir to the piston. The generated pressure and fluid volume flow is approximately proportional to the relative speed and is a function of fluid viscosity and geometry of the shear channel. Transferring this linear model into a rotating system, the second plate becomes a simple disc (the feed disc) fixed to the hub and the first plate with the channel becomes a grooved disc (the pump disc) fixed to the housing. The hub drives the feed disc rotatably relative to the pump disc. The pump disc includes a circumferential pumping groove and connecting holes forming the shear channel in conjunction with the feed disc end face. The shear pump is covered by a pressure piston whereas the reservoir is covered by a spring-loaded compensation piston on the opposite side of the housing or cover.

The fluid is drawn out from the reservoir via the connecting hole in the pump disc, then moved through the channel due to the shear forces when the feed disc rotates relative to the pump disc, and directed between feed disc and pressure piston in the pressure chamber. The generated pressure acts upon the pressure piston in a limited-slip differential application by forcing the pressure piston against a friction clutch as well as forcing the feed disc against the pump disc assuring a tight seal. Due to this self-sealing effect, there is no need for a complex sealing design.

Single directional operation of the shear pump occurs when the pump disc is non-rotatable relative to the housing or cover of the limited-slip differential. To provide the shear pump with bi-directional operation, an additional control function is used that allows correct orientation of the reservoir to the suction side of the pump disc in either rotational direction. This is accomplished by allowing the pump disc to have two rotational positions in the housing (indexable). Depending on the slip speed direction, the pump disc automatically indexes, thus allowing the suction side and outlet side of the pump disc to be correctly aligned to the reservoir and pressure chamber. The switching function also enables an asymmetric pressure characteristic for both slip speed directions to be built into the limited-slip differential if required.

A feature of the shear pump is that it is self-contained and independent, requiring no external source of viscous fluid or servicing. The system can be internally or externally mounted and provides significant benefits in packaging, durability, and weight compared to conventional vane type or gerotor type pump systems. The pump is filled with a hydraulic fluid, typically, silicone fluid. The physical properties of the silicone fluid provide superior temperature stability, minimal temperature sensitivity, and excellent durability. However, one fluid property weakness of silicone fluid is that its viscosity is linearly related and decreases with increasing temperature. Another feature of the shear pump, is that the pump pressure characteristic, in general, is linear versus the speed difference and can be tuned by the pump disc geometry and by selecting the silicone fluid having a particular viscosity. However, there is no compensating or tuning capability in the current art that can offset or efficiently control the decreasing viscosity of the viscous fluid as the temperature increases.

The generated fluid flow of the shear pump is a function of the pump design, the pump pressure and the slip speed. The fluid flow rate of the shear pump decreases with increasing pump pressure and tends to zero when the pressure reaches its maximum. Independent of the slip speed acceleration, the pump pressure always approaches its specific maximum in an asymptotic manner. This unique feature of the shear pump guarantees a smooth torque engagement without any torque peaks. When the slip is reduced, the pressure applied is quickly released via the shear channel into the reservoir.

Conventional gear or vane type pumps generate a pressure with a certain periodical fluctuation versus one revolution. This may cause a pulsating bias torque which can excite torsional vibrations and noises, especially when used in a driveline. Due to the new working principle, the pressure generated in the shear pump is constant without any fluctuation particularly at very low slip speeds. The shear pump as a self-controlling stand-alone device can be applied as a limited-slip differential in front and rear axles as well as in center differentials, or directly as an "on demand" torque transmission between the axles of a 4WD vehicle. The shear pump can be used in other applications, especially so where continuous non-pulsating pressure and or flow requirement as a function of pump velocity are of interest. However, all shear pump applications are subject to the decreasing performance effect caused by the temperature related viscosity of the hydraulic fluid.

Therefore, there is a need for a temperature compensated shear pump that will mitigate the temperature related viscosity change in the fluid and further enhance shear pump performance.

SUMMARY OF THE INVENTION

The present invention provides a temperature compensated hydraulic shear pump that mitigates the temperature related viscosity change in the fluid and further enhances shear pump performance. A temperature compensation element allows the temperature dependent viscous fluid viscosity change to be compensated by changing the pump's shear channel height as a function of temperature to achieve a desired pump pressure output.

Hydraulic shear pumps output pressure and fluid flow. Pressure is the primary output in a shear pump when used in a speed sensing limited-slip differential, whereas the fluid flow is more significant in other types of applications, e.g., fluid lubricating systems, but nonetheless still important in limited-slip type applications. The maximum pressure difference in the shear channel is dependent on the dynamic fluid viscosity, channel length, and relative speed divided by the channel height squared. Channel height and fluid viscosity are temperature dependent, so temperature changes cause a change in pump pressure. For example, an increase in temperature causes the fluid viscosity to decrease, resulting in a decrease in pump output pressure. The pressure output is further decreased with increasing temperature because of the increasing channel height. The channel height increases due to thermal expansion of the channel walls when constructed from a single material. Thus, pressure output in the shear pump is affected by temperature increases, which causes a reduction in the fluid viscosity and a change in channel height. The temperature related pressure change may be controlled, as in the present invention, when the channel is formed out of two or more materials having different thermal expansion properties.

Pump pressure output can be controlled as temperature changes by a temperature compensation element. The channel height varies as a function of temperature when the channel walls and temperature compensation element are constructed from materials having different coefficients of thermal expansion. By selecting a combination of materials, the channel height can increase, decrease, or remain constant as the temperature is changed. Ignoring, for the moment, the effects of viscosity, channel length, and relative speed, the effect of channel height on pump output pressure can be assessed. By increasing channel height as temperature increases, the pressure will decrease. By keeping the channel height constant as temperature increases, the pressure will remain constant. By decreasing channel height as temperature increases, the pressure will increase. Therefore, a shear channel constructed out of two or more materials enables a pump to have a pressure profile as a function of temperature for a given viscous fluid.

One embodiment of the present invention has a pump disc constructed from a material having a lower coefficient of thermal expansion and the temperature compensation element constructed from a material having a higher coefficient of thermal expansion layered in the bottom of the shear channel of the pump disc. The resulting effect is to have a channel height that decreases with increasing temperature. By decreasing the channel height at higher temperatures, the pressure output is more constant over the temperature range by compensating for the drop in fluid viscosity as the temperature increases. It should be noted for this embodiment, the pump pressure could decrease, remain constant, or increase depending upon the selected fluid viscosity temperature curve and the materials ratio of thermal expansion coefficients. For a particular viscous fluid the shear channel materials may be selected such as to increase, maintain or decrease channel height in order to achieve a particular pressure output as a function of temperature.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION

In all Figures, items and call outs are uniquely numbered. As such, the item number represents a single item, or its equivalent, when depicted on multiple figures. Also, the item numbered upon one figure can be taken to be the same item on another figure that calls it out, if it is not shown or numbered. In some instances, for clarity, equivalent parts in different Figures will have different item numbers.

Figure 1:
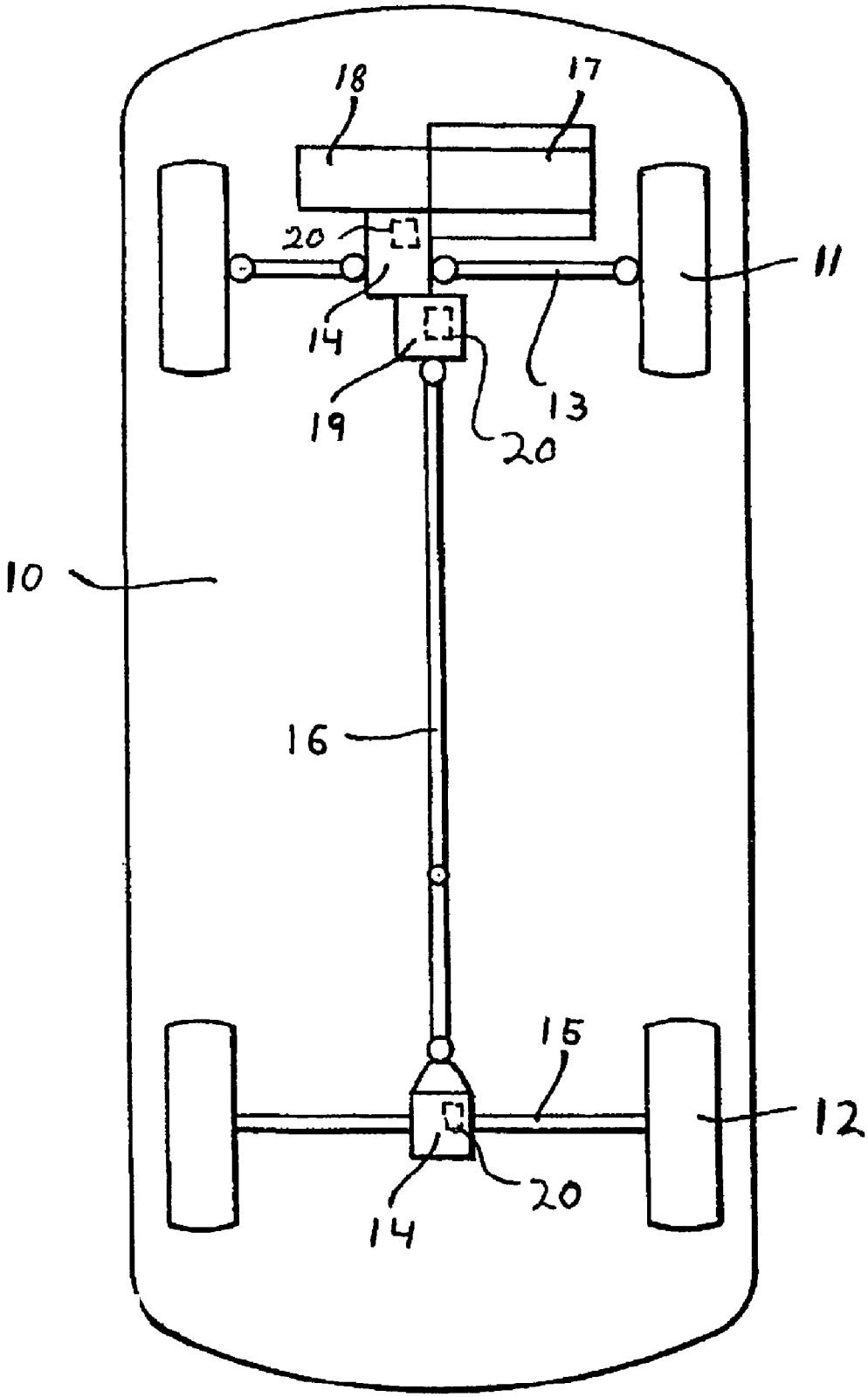
FIG. 1 shows a plan view of a motor vehicle with a temperature compensated hydraulic shear pump in accordance with one embodiment of the present invention.

FIG. 1 shows a plan view of a motor vehicle 10 with a temperature compensated hydraulic shear pump 20 in accordance with one embodiment the invention. The motor vehicle 10 is provided with two rear wheels 12 and two front wheels 11. The two front wheels 11 are driven by the driving parts of a front axle 13 having an axle differential 14 and the two rear wheels 12 which are driven by the driving parts of a rear axle 15 having an axle differential 14. The motor vehicle comprises an engine 17 which constitutes the driving force source and is connected to a transmission 18 for adapting the speed range of the engine 17 to the speed range of the motor vehicle 10.

In one embodiment, the output end of the transmission 18 is connected to the input end of the axle differential 14 of the front axle 13 and, by means of a through-drive, to a coupling unit 19 which operates at the same speed and which, by means of a propeller shaft 16, drives the input end of the differential 14 of the rear axle 15. The torque introduced is distributed to the wheels of the respective axle shaft by the front and rear axle differentials 14. The axle differentials 14 may each be equipped with a speed sensing type of a limited-slip differential having integrated into it a temperature compensated hydraulic shear pump 20 in accordance with the present invention as described below. With one of the parts of the limited-slip differential rotatable relative to the other and being formed by the differential carrier or one of the axle shaft gears, and with the other one of the parts rotatable relative to the other and being formed by the other of the axle shaft gears. The coupling unit 19 may be as proposed by the invention, with one of the parts rotatable relative to the other and being formed by the driving parts of the transmission 18 and the other one of the parts rotatable relative to the other and being formed by the connecting parts of the propeller shaft 16.

In another embodiment, the motor vehicle comprises a central differential drive 19 whose input end, by means of a through-drive, is connected to the output end of the transmission 18. The central differential drive 19 distributes the introduced torque to the axle differential 14 of the front axle 13 and to the axle differential 14 of the rear axle 15. Each of the differentials, the front and the rear axle differential drives 14 and the central differential 19 may be equipped with a speed sensing type of a limited-slip differential having integrated into it a temperature compensated hydraulic shear pump 20 in accordance with the present invention as described below. With one of the parts of the limited-slip differential rotatable relative to the other and being formed by the differential carrier or one of the axle shaft gears, and with the other one of the parts rotatable relative to the other and being formed by the other of the axle shaft gears.

Figure 2:
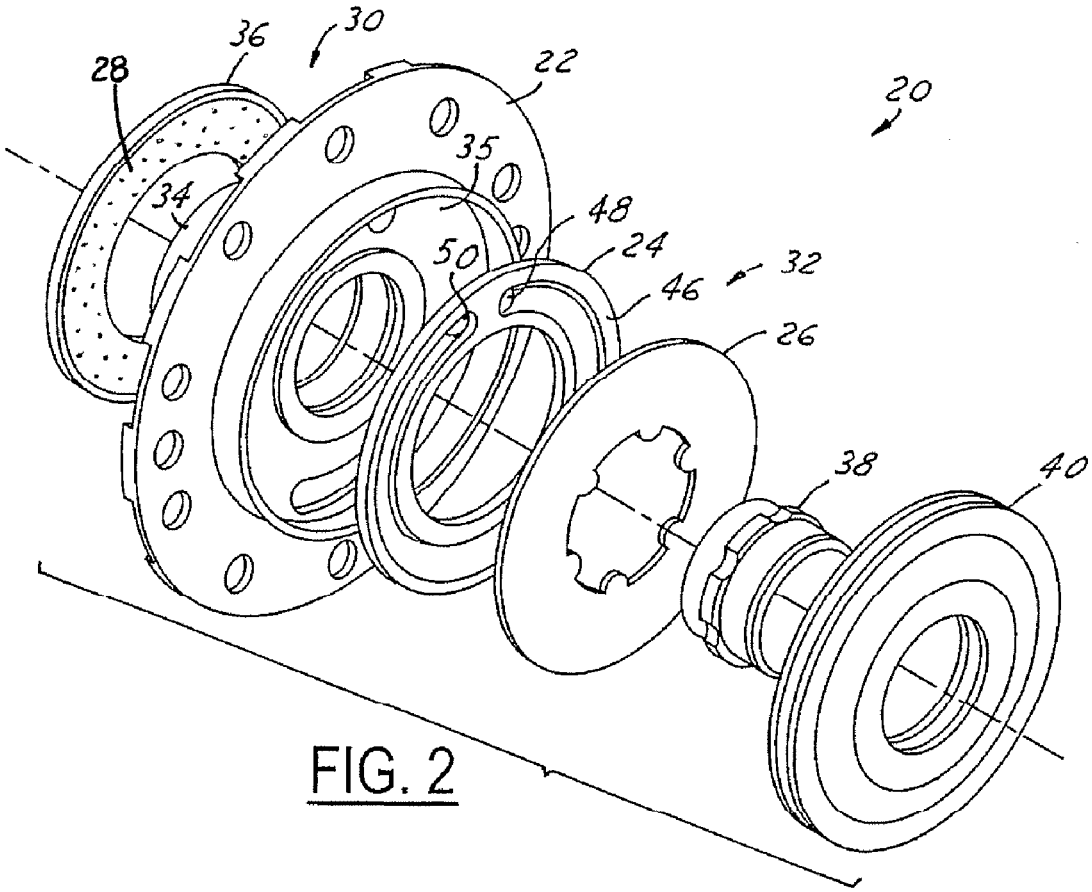
FIG. 2 shows a schematic view of a temperature compensated hydraulic shear pump assembly integrated in the cover of a limited-slip differential in accordance with one embodiment of the present invention.

FIG. 2 shows a schematic view of a temperature compensated hydraulic shear pump 20 assembly integrated in the cover 22 of a speed sensing limited-slip differential in accordance with an embodiment of the invention. The following embodiment is only exemplary of an application having a temperature compensated hydraulic shear pump. The temperature compensated hydraulic shear pump 20 is comprised of a viscous fluid 28, a fluid reservoir 30, a pump disc 24, a feed disc 26, and a pressure chamber 32. A compensation piston 36 is coupled to a first side 34 of the cover 22 of a speed sensing limited-slip differential creating the fluid reservoir 30 containing the viscous fluid 28. The pump disk 24 is coupled to a second side 35 of the cover 22. The pump disk 24 is non-rotatable or indexable, but it is not continuously rotatable within the cover 22. The pump disc 24 has a temperature compensation channel 42. The temperature compensation channel 42 comprises a radial length L and a height S. The temperature compensation channel 42 is located and open on the top side 46 of pump disc 24 abutting a feed disk 26 which encloses the temperature compensation channel 42 and is rotatable relative thereto forming a shear gap 43. The feed disk 26 is mechanically coupled to a drive 38 and rotatably coupled to the pump disk 24. A pressure piston 40 sandwiches the feed disk 26 and the pump disk 24 between the second side 35 of the cover 22 creating a pressure chamber 32. The compensation piston 36 and pressure piston 40 contain the temperature compensating hydraulic shear pump 20 inside the cover 22 and the drive 38 rotatable relative thereto and maintain sealing therein. When the drive 38 rotates the feed disc 26 relative to the pump disc 24, the viscous fluid 28 is fluidly communicated, by viscous shear forces, from the fluid reservoir 30 through the cover 22 into a first port 48 located in pump disc 24 into and through the shear gap 43 located within the temperature compensation channel 42 out of a second port 50 and into the pressure chamber 32, wherein pressure is exerted upon the pressure piston 40. The second port 50 is located at the other end of the temperature compensation channel 42 from the first port 48. With the cover 22 of the limited-slip differential rotatable relative to the drive 38 being formed by the differential carrier of one of the axle shaft gears, and with the drive 38 rotatable relative to the cover 22 being formed by the other of the axle shaft gears, the piston acting upon the parts of the coupling unit, the central differential, or the axle differential distributes torque to the wheels through the propeller shaft and or the axles.

Figure 3:
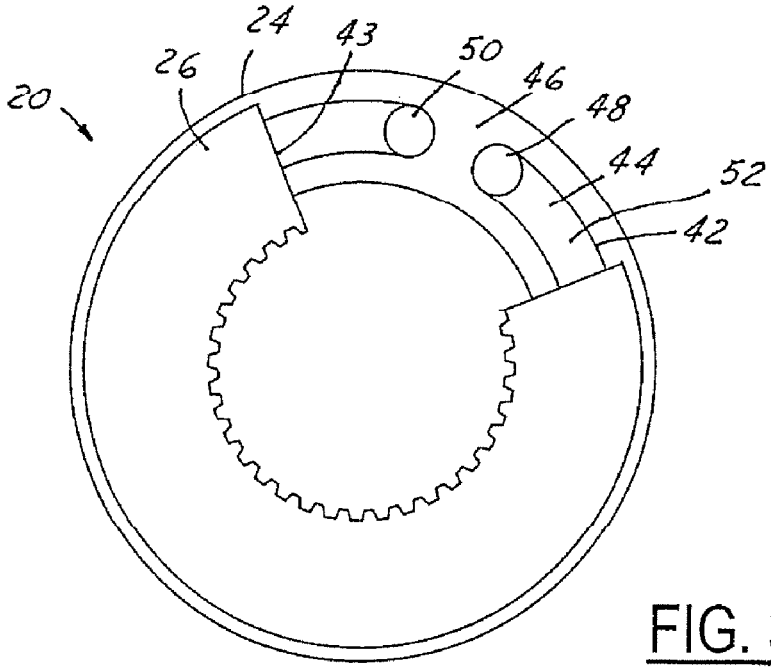
FIG. 3 shows a partial cut away view of a temperature compensated hydraulic shear pump in accordance with one embodiment of the present invention.

FIG. 3 shows a partial cut away view of a temperature compensated hydraulic shear pump 20 in accordance with an embodiment of the invention. The pump disc 24 has a temperature compensation channel 42. The temperature compensation channel 42 comprises a radial length L and a height S. The temperature compensation channel 42 is located and open to the top side 46 of pump disc 24 and abuts the feed disk 26 which encloses the temperature compensation channel 42 forming the shear gap 43. The feed disk 26 is rotatably coupled to the pump disk 24. The temperature compensation channel 42 of the pump disk 24, in accordance with the present invention, is formed of a first material for the pump disk 24 and a different second material for the temperature compensating element 52 coupled to the shear channel 44 forming the temperature compensation channel 42. The two materials have different coefficients of thermal expansion. The temperature compensation channel 42 extends circumferentially upon the pump disk 24 and communicates with a first port 48 extending through the pump disk 24. The other end of temperature compensation channel 42 communicates with a second port 50 extending through the pump disk 24. When the feed disc 26 rotates relative to the pump disc 24, the viscous fluid 28 is fluidly communicated from a fluid reservoir into a first port 48 located in pump disc 24 into and through the shear gap 43 located within the temperature compensation channel 42 out of a second port 50 located at the opposite end of the temperature compensation channel 42 and into a pressure chamber.

Figure 4:
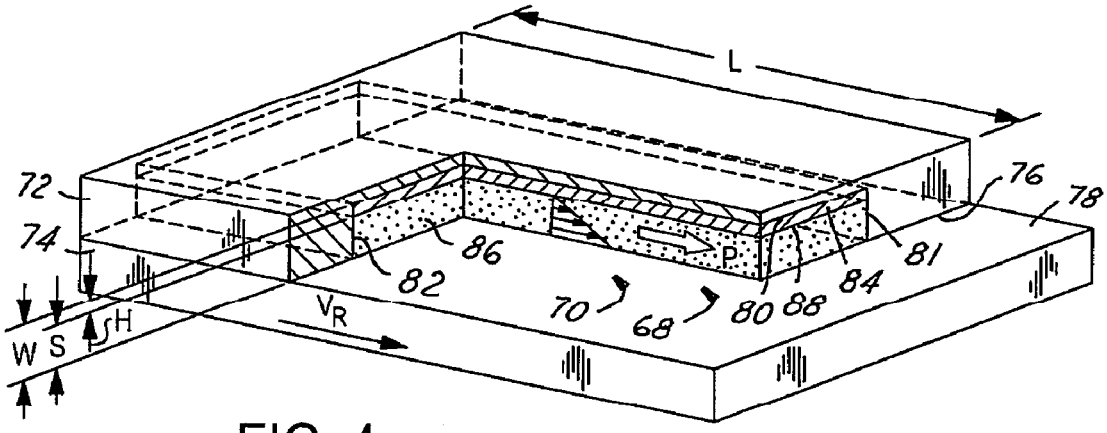
FIG. 4 shows two plates which are movable relative to one another, with a section having been broken away and with one of the plates having been provided with a groove forming a shear channel having a temperature compensating element in accordance with one embodiment of the present invention.

FIG. 4 shows two plates which are movable relative to one another, with a section having been broken away and with one of the plates 72 having been provided with a groove 80 forming a shear channel 70 having a temperature compensating element 84 in accordance with the invention. The shear channel 70 has a first plate or pump disc 72 and a second plate or feed disc 74 whose top faces 76, 78 contact one another. The first plate 72 is assumed to be fixed; the second plate 74 moves at a speed of $V_r$. The first plate 72 is made from a material having a coefficient of thermal expansion. The top face 76 of the first plate 72 is provided with a groove 80 which comprises a rectangular cross-section and delimiting side walls 81, 82. A temperature compensating element 84 which comprises a rectangular cross-section having thickness H and length L is coupled to the groove 80 and delimited by side walls 81, 82. The temperature compensating element 84 is made from a material having a coefficient of thermal expansion different from the material of the first plate 72. The temperature compensating element 84 coupled to the groove 80 and the top face 76 form a shear channel 70. The shear channel 70 comprises a length L and a height S forming a shear gap 68 accommodating a viscous fluid 86. The resulting height S of the shear channel 70 has a linear temperature relationship as determined by the material combination of the first plate 72 and the temperature compensating element 84. When the second plate 74 moves relative to the first plate 72, the viscous fluid 86 in the shear groove behaves in accordance with the given linear speed profile referring to the fixed first plate 72. The top face 78 of the second plate 74 and the top surface 88 of the temperature compensating element 84 coupled to groove 80 of first plate 72 undergoing the applied adhesion or visco type force conditions as induced by the viscous fluid 86, results in a linear speed profile with respect to the second plate 74. The linear speed profile is also reciprocal with respect to the first plate 72. With reference to first plate 72 or second plate 74, the shear effect of the shear channel 70 generates a pressure P and a flow quantity Q.

As the applications illustrated here are not based on relative linear movements but on relative rotational movements, the groove forming the shear gap is preferably designed so as to extend circumferentially upon the first plate or pump disc, as illustrated in FIG. 3.

Figure 5A:
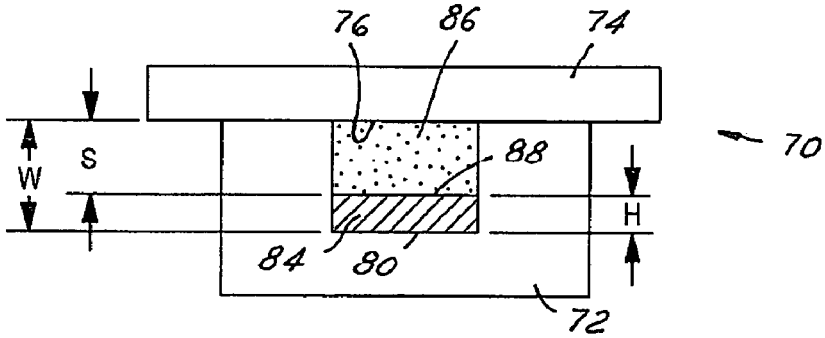
FIGS. 5A and 5B show a cross section of the shear channel having a temperature compensating element in accordance with one embodiment of the invention.
Figure 5B:
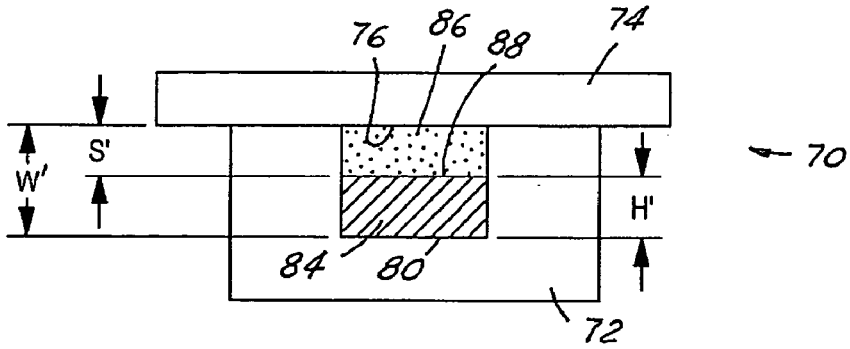

FIGS. 5A and 5B show a cross section of the shear channel 70 having a temperature compensating element 84 in accordance with an embodiment of the invention. FIG. 5A shows the height S, at a temperature, of shear channel 70 through which the viscous fluid 86 is sheared upon motion between the first plate 72 and the second plate 74. The height S is the difference of depth W of groove 80 of the first plate 72 and the thickness H of the temperature compensating element 84. Alternatively, the height S is the distance between the top surface 88 of the temperature compensating element 84 and the top face 76 of the first plate 72. The groove depth W and the thickness H are linearly independent. The groove depth W, as determined by the material of the first plate 72, will increase or decrease with increasing and decreasing temperature, respectfully. The thickness H, as determined by the material of the temperature compensating element 84, will increase or decrease with increasing and decreasing temperature, respectfully. The height S, at different temperatures, may increase or decrease for a given temperature change and depends upon the coefficients of thermal expansion for each material of the temperature compensating element 84 and the first plate 72.

FIG. 5B shows the height S', at a higher temperature, of shear channel 70 through which the viscous fluid 86 is sheared upon motion between the first plate 72 and the second plate 74. The height S' is the difference of depth W' of groove 80 of the first plate 72 and the thickness H' of the temperature compensating element 84. Alternatively, the height S' is the distance between the top surface 88 of the temperature compensating element 84 and the top face 76 of the first plate 72. The groove depth W' and the thickness H' are linearly independent. The groove depth W', as determined by the material of the first plate 72, will increase or decrease with increasing and decreasing temperature, respectfully. The thickness H', as determined by the material of the temperature compensating element 84, will increase or decrease with increasing and decreasing temperature, respectfully. The height S', at different temperatures, may increase or decrease for a given temperature change and depends upon the coefficients of thermal expansion for each material of the temperature compensating element 84 and the first plate 72. For increasing temperature the material with the greater coefficient of thermal expansion will increase the thickness, height, or depth at a greater rate as compared to the material with the lower coefficient of thermal expansion. In this embodiment of the invention, the coefficient of thermal expansion for the temperature compensating element 84 is greater than the coefficient of thermal expansion for the first plate 72. The thickness H' of the temperature compensating element 84 increase at a greater rate than the groove depth W' resulting with a decrease in height S' in the shear channel 70 for increasing temperature.

Alternatively, in another embodiment, the coefficient of thermal expansion for the temperature compensating element 84 is lower than the coefficient of thermal expansion for the first plate 72. The thickness H" of the temperature compensating element 84 increase at a slower rate than the groove depth W" resulting in an increase in height S" in the shear channel 70 for increasing temperature.

Hydraulic shear pumps output pressure and fluid flow. The maximum pressure difference in the shear channel is dependent on the dynamic fluid viscosity, channel length, and relative speed divided by the channel height squared. Channel height and fluid viscosity are temperature dependent, so temperature changes cause a change in pump pressure. For example, an increase in temperature causes the fluid viscosity to decrease, resulting in a decrease in pump output pressure. The pressure output is further decreased with increasing temperature because of the increasing channel height. The channel height increases due to thermal expansion of the channel walls when constructed from a single material. Thus, pressure output in the shear pump is affected by temperature increases, which causes a reduction in the fluid viscosity and a change in channel height. The temperature related pressure change may be controlled, as in the present invention, when the channel is formed out of two or more materials having different thermal expansion properties.

Pump pressure output can be controlled as temperature changes by a temperature compensation element. The channel height varies as a function of temperature when the channel walls and temperature compensation element are constructed from materials having different coefficients of thermal expansion. By selecting a combination of materials, the channel height can increase, decrease, or remain constant as the temperature is changed. Ignoring, for the moment, the effects of viscosity, channel length, and relative speed we can assess the effect of channel height on pump output pressure. By increasing channel height as temperature increases, the pressure will decrease. By keeping the channel height constant as temperature increases, the pressure will remain constant. By decreasing channel height as temperature increases, the pressure will increase. Therefore, a shear channel constructed out of two or more materials will enable a pump to have a pressure profile as a function of temperature for a given viscous fluid.

The embodiment of the present invention has a pump disc constructed from metal, e.g., nitrided carbon steel, or other suitable materials such as polyplastic type materials, e.g., polyphenylene sulphide with glass fiber reinforcement. The polyphenylene sulphide material has a lower coefficient of thermal expansion than the temperature compensation element. The temperature compensation element is constructed from a polymer, e.g., polyisoprene or rubber, or from any other compatible materials having a higher coefficient of thermal expansion. The polymer is coupled to the groove of the shear channel of the pump disc. The material of the pump disc may include other metals and other material groups known to be suitable for shear pump disk construction. The material of the temperature compensation element may include other plastics, elastomer and other material groups, including metals. The materials are coupled by injection molding, gluing, riveting, adhering or other means known to those in the art for the selected material combinations. The materials also should be selected having a compatibility with the selected hydraulic fluid. In the present embodiment, the materials selected are compatible with silicone fluid which is used as the hydraulic fluid. The resulting effect is to have a shear channel height that decreases with increasing temperature. By decreasing the channel height at higher temperatures, the pressure output is more constant over the temperature range by compensating for the drop in fluid viscosity as the temperature increases. It should be noted for this embodiment, the pump pressure could decrease, remain constant, or increase depending upon the selected fluid viscosity temperature curve and the materials ratio of thermal expansion coefficients. For a particular viscous fluid the shear channel materials may be selected such as to increase, maintain or decrease channel height in order to achieve a particular pressure output as a function of temperature. The resulting temperature compensation provides a more consistent pump pressure over a temperature range. When applied to a speed-sensing limited-slip differential, the locking torque characteristic will be more consistent over the entire operating range.

While the invention has been described in connection with several embodiments, it should be understood that the invention is not limited to those embodiments. Thus, the invention covers all alternatives, modifications, and equivalents as may be included in the spirit and scope of the appended claims.

What is claimed is:

1. A temperature compensating hydraulic shear pump comprising:

a pump disc;

a feed disc rotatable with respect to the pump disc;

a generally circumferential, laterally-sealed shear channel formed by and between the pump disc and the feed disc, the shear channel comprising a groove laterally delimited by side walls of the pump disc and a top face of the feed disc;

at least two ports in the pump disc, said ports communicating with the shear channel and spaced apart relative to one another circumferentially along the shear channel;

a temperature compensation element coupled to the groove and delimited by the side walls; and a viscous fluid so that upon relative rotation between the pump disc and the feed disc the viscous fluid is conveyed by shear force from one of the ports, along the shear channel and through the other of said ports.

2. The temperature compensating hydraulic shear pump of claim 1 wherein the pump disc and the temperature compensation element are made from different materials having defined coefficients of thermal expansion.

3. The temperature compensating hydraulic shear pump of claim 2 wherein the pump disk is made from fiber reinforced polyphenylene sulfide and the temperature compensation element is made from rubber.

4. The temperature compensating hydraulic shear pump of claim 2 wherein the pump disc has a lower coefficient of thermal expansion than the temperature compensation element.

5. The temperature compensating hydraulic shear pump of claim 2 wherein the pump disc has a similar coefficient of thermal expansion than the temperature compensation element.

6. The temperature compensating hydraulic shear pump of claim 2 wherein the pump disc has a greater coefficient of thermal expansion than the temperature compensation element.

7. The temperature compensating hydraulic shear pump of claim 1 wherein the viscous fluid is silicone.

8. A temperature compensating hydraulic shear pump assembly comprising:

a cover;

a drive rotatable relative to the cover;

a compensation piston coupled to the cover forming a fluid reservoir, the fluid reservoir filled with a viscous fluid;

a pump disc coupled to the cover;

a feed disc non-rotatably coupled to the drive and rotatable with respect to the pump disc;

a pressure piston coupled to the cover and movable laterally thereto, forming a pressure chamber housing the pump disc and the feed disk;

a generally circumferential, laterally-sealed shear channel formed by and between the pump disc and the feed disc, the shear channel comprising a groove laterally delimited by side walls of the pump disc and a top face of the feed disc;

a temperature compensation element coupled to the groove and delimited by the side walls; and at least two ports in the pump disc, said ports communicating with the shear channel and spaced apart relative to one another circumferentially along the shear channel, one of the ports communicating with the fluid reservoir and the other of the ports communicating with the pressure chamber so that upon relative rotation between the pump disc and the feed disc the viscous fluid is conveyed by shear force from the reservoir through one of the ports, along the shear channel and through the other of said ports into the pressure chamber loading the pressure piston.

9. The temperature compensating hydraulic shear pump assembly of claim 8 wherein the pump disc and the temperature compensation element are made from different materials having defined coefficients of thermal expansion.

10. The temperature compensating hydraulic shear pump assembly of claim 9 wherein the pump disk is made from fiber reinforced polyphenylene sulfide and the temperature compensation element is made from rubber.

11. The temperature compensating hydraulic shear pump assembly of claim 9 wherein the pump disc has a lower coefficient of thermal expansion than the temperature compensation element.

12. The temperature compensating hydraulic shear pump assembly of claim 9 wherein the pump disc has a similar coefficient of thermal expansion than the temperature compensation element.

13. The temperature compensating hydraulic shear pump assembly of claim 9 wherein the pump disc has a greater coefficient of thermal expansion than the temperature compensation element.

14. The temperature compensating hydraulic shear pump assembly of claim 8 wherein the viscous fluid is silicone.

15. A temperature compensating hydraulic shear pump assembly for transmitting torque in an automotive vehicle having a coupling unit comprising:

the coupling unit having a first rotatable part and a second rotatable part;

a cover connected to the first rotatable part;

a drive connected to the second rotatable part and rotatable relative to the cover;

a compensation piston coupled to the cover forming a fluid reservoir, the fluid reservoir filled with a viscous fluid;

a pump disc coupled to the cover;

a feed disc non-rotatably coupled to the drive and rotatable with respect to the pump disc;

a pressure piston coupled to the cover and movable laterally thereto, forming a pressure chamber housing the pump disc and the feed disk;

a generally circumferential, laterally-sealed shear channel formed by and between the pump disc and the feed disc, the shear channel comprising a groove laterally delimited by side walls of the pump disc and a top face of the feed disc;

a temperature compensation element coupled to the groove and delimited by the side walls; and at least two ports in the pump disc, said ports communicating with the shear channel and spaced apart relative to one another circumferentially along the shear channel, one of the ports communicating with the fluid reservoir and the other of the ports communicating with the pressure chamber so that upon relative rotation between the pump disc and the feed disc the viscous fluid is conveyed by shear force from the reservoir through one of the ports, along the shear channel and through the other of said ports into the pressure chamber loading the pressure piston, the pressure piston driving the first rotatable part and the second rotatable part of the coupling unit relatively to one another.

16. The temperature compensating hydraulic shear pump assembly of claim 15 wherein the pump disc and the temperature compensation element are made from different materials having defined coefficients of thermal expansion.

17. The temperature compensating hydraulic shear pump assembly of claim 16 wherein the pump disk is made from fiber reinforced polyphenylene sulfide and the temperature compensation element is made from rubber.

18. The temperature compensating hydraulic shear pump assembly of claim 16 wherein the pump disc has a lower coefficient of thermal expansion than the temperature compensation element.

19. The temperature compensating hydraulic shear pump assembly of claim 15 wherein the coupling unit is a limited slip differential.

20. The temperature compensating hydraulic shear pump assembly of claim 15 wherein the viscous fluid is silicone.

* * * * *